United States Patent [19]

Alpert

[11] Patent Number: 4,834,015

[45] Date of Patent: May 30, 1989

[54] ANCHOR DEVICE

[76] Inventor: Barnett S. Alpert, NMCB-62-EO, FPO Miami, Fla. 34099-5001

[21] Appl. No.: 164,952

[22] Filed: Mar. 7, 1988

[51] Int. Cl.[4] ..... B63B 21/24

[52] U.S. Cl. ..... 114/294; 114/311; 135/20 R; 441/136

[58] Field of Search ..... 220/1 R; 441/1, 129–132, 441/136; 114/294, 300, 301, 311; 135/20 R, 20 A, 87, 98

[56] References Cited

U.S. PATENT DOCUMENTS

| | | | |
|---|---|---|---|
| D. 181,102 | 10/1957 | Kurt | D12/215 |
| D. 191,726 | 11/1961 | DiVietro | D12/215 |
| D. 195,796 | 7/1963 | Christinsen | D12/215 |
| D. 203,485 | 1/1966 | Shepherd | D12/215 |
| D. 203,525 | 1/1966 | Hutton | D12/215 |
| 305,186 | 9/1884 | Herman | 114/301 |
| 1,148,924 | 8/1915 | Paradise | 114/294 X |
| 2,289,647 | 7/1942 | Grossenbach | 114/294 X |
| 2,529,961 | 11/1950 | Phillips | 441/131 |
| 2,803,839 | 8/1957 | Mosley | 441/131 |
| 3,441,038 | 4/1969 | Mathews | 135/20 R |
| 3,748,672 | 7/1973 | Patrick et al. | 441/131 |
| 4,312,371 | 1/1982 | Koon | 135/20 R |

*Primary Examiner*—Sherman D. Basinger
*Attorney, Agent, or Firm*—Jerry T. Kearns

[57] ABSTRACT

An anchor device for use with inflatable rafts and cushions includes a compartmentalized cylindrical tray. The tray is designed to store beverage containers and the personal effects of an individual floating on a raft or cushion. A sunshade may be adjustably secured to the tray. A pair of attaching loops are utilized to connect the floating tray to an anchor and to an inflatable raft or cushion. A spoon type anchor is disclosed for use in lakes and ponds and a weighted anchor is disclosed for use in pools. The anchor and raft attaching loops may be pivotally mounted on the circular tray. The sunshade mounting socket may be slidably mounted. A styrofoam filled compartment may be provided in the cylindrical tray for ensuring flotation.

15 Claims, 5 Drawing Sheets

ANCHOR DEVICE

BACKGROUND OF THE INVENTION

1. Field of the Invention

The present invention relates to anchor devices, and more particularly pertains to a new and improved anchor device designed for use in lakes, ponds, and swimming pools for securing inflatable rafts and cushions in a desired location. Individuals sunbathing on inflatable rafts and cushions are prone to drift from their desired location because of wind and water currents. In swimming pools, this results in the bumping of the rafts or cushions into the walls of the pool or into other individuals. In a lake or pond, this drifting can be dangerous. Also, individuals sunbathing on such inflatable rafts and cushions require a storage area for their keys and other personal belongings and also require a beverage container holder. In order to solve all of these problems, the present invention provides an anchor device which includes a compartmentalized tray having an adjustable sunshade and a plurality of storage compartments. It is safe to use in all types of pools and has no sharp edges to cut or perforate plastic liners. On the beach or poolside the anchor device will hold blankets, towels or mats in place.

2. Description of the Prior Art

Various types of anchor devices are known in the prior art. A typical example of such an anchor device is to be found in U.S. Pat. No. Des. 181,102, which issued to F. Kurt et al on Oct. 1, 1957. This patent discloses a generally cylindrical mooring buoy having an anchor rope attaching loop and a central flag staff. U.S. Pat. No. Des. 191,726, which issued to J. Divietro on Nov. 7, 1961, discloses an anchor having a conically tapered body portion with a plurality of radially extending projections. U.S. Pat. No. Des. 195,796, which issued to J. Christiansen on July 30, 1963, discloses an inflatable flag for use by divers. The device includes a strap attaching loop and a generally rectangular flag. U.S. Pat. No. Des. 203,485, which issued to C. Shepherd on Jan. 11, 1966, discloses a buoy having a generally frustoconical body portion provided with a pair of attaching loops at opposite ends thereof. U.S. Pat. No. Des. 203,525, which issued to C. Hutton on Jan. 18, 1966, discloses a boat anchor having a generally rectangular body portion provided with a plurality of spaced radial projections. An attaching loop for securement of an anchor rope is connected at one end of the rectangular body portion.

While the above mentioned devices are suited for their intended usage, none of these devices provide a suitable restraint for use by sunbathers on inflatable rafts and cushions. Additionally, none of the aforesaid anchor devices provide a circular compartmentalized storage tray having an attached adjustable sunshade. Inasmuch as the art is relatively crowded with respect to these various types of anchor devices, it can be appreciated that there is a continuing need for and interest in improvements to such anchor devices, and in this respect, the present invention addresses this need and interest.

SUMMARY OF THE INVENTION

In view of the foregoing disadvantages inherent in the known types of anchor devices now present in the prior art, the present invention provides an improved anchor device. As such, the general purpose of the present invention, which will be described subsequently in greater detail, is to provide a new and improved anchor device which has all the advantages of the prior art anchor devices and none of the disadvantages.

To attain this, representative embodiments of the concepts of the present invention are illustrated in the drawings and make use of an anchor device for use with inflatable rafts and cushions which includes a compartmentalized cylindrical tray. The tray is designed to store beverage containers and the personal effects of an individual floating on a raft or cushion. A sunshade may be adjustably secured to the tray. A pair of attaching loops are utilized to connect the floating tray to an anchor and to an inflatable raft or cushion. A spoon type anchor is disclosed for use in lakes and ponds and a weighted anchor is disclosed for use in pools. The anchor and raft attaching loops may be pivotally mounted on the circular tray. The sunshade mounting socket may be slidably mounted. A styrofoam filled compartment may be provided in the cylindrical tray for ensuring flotation.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting. As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved anchor device which has all the advantages of the prior art anchor devices and none of the disadvantages.

It is another object of the present invention to provide a new and improved anchor device which ay be easily and efficiently manufactured and marketed.

It is a further object of the present invention to provide a new and improved anchor device which is of a durable and reliable construction.

An even further object of the present invention is to provide a new and improved anchor device which is susceptible of a low cost of manufacture with regard to both materials and labor, and which accordingly is then susceptible of low prices of sale to the consuming public, thereby making such anchor devices economically available to the buying public.

Still yet another object of the present invention is to provide a new and improved anchor device which provides in the apparatuses and methods of the prior art some of the advantages thereof, while simultaneously overcoming some of the disadvantages normally associated therewith.

Still another object of the present invention is to provide a new and improved anchor device for use by sunbathers in securing inflatable rafts and cushions at a desired location in a lake, pond or swimming pool.

Yet another object of the present invention is to provide a new and improved anchor device for use by sunbathers in securing inflatable rafts and cushions in a desired location which also provides a compartmentalized storage tray and an adjustable sunshade.

Even still another object of the present invention is to provide a new and improved anchor device which provides adjustable loop connections for securement to an inflatable raft and cushion and to an anchor rope.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
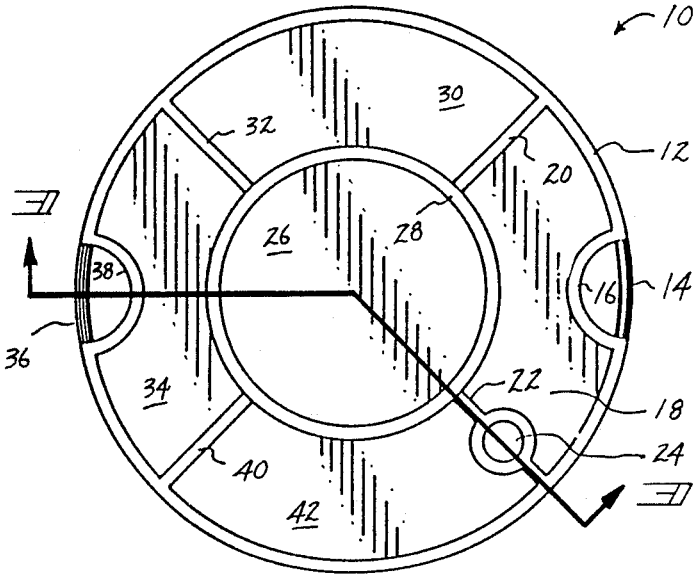
FIG. 1 is a top view of a compartmentalized tray of an anchor device according to a first embodiment of the present invention.

With reference now to the drawings, and in particular to FIG. 1 thereof, a new and improved anchor device embodying the principles and concepts of the present invention and generally designated by the reference numeral 10 will be described.

More specifically, it will be noted that the first embodiment 10 of the invention includes a cylindrical tray 12 which has a raft tether rod 14 which spans a semicircular recess 16 formed in the outer wall of the tray 12. A raft or inflatable cushion may be tethered to the rod 14 by a short length of rope or cord. The tray 12 is designed to float on the surface of a body of water, adjacent an individual sunbathing on an inflatable raft or cushion. The tray 12 is divided into a plurality of compartments 18, 30, 34 and 42 by a plurality of radially extending circumferentially spaced vertical dividing walls 20, 22 32, and 40. A central beverage holder 26 is formed by an upstanding cylindrical wall 28. The radially extending dividers 20, 22, 32 and 40 extend between the cylindrical wall 28 and the outer cylindrical wall of the tray 12. A second tether rod 36 spans a semicircular recess 38 provided diametrically opposite the first semicircular recess 16. The second tether rod 36 is designed for securement of an anchor rope to the tray 12. The anchor rope is attached to an anchor on the bottom of the body of water on which the tray 12 is floating. Thus, the tray 12 and attached anchor serve to restrain an inflatable raft or cushion in a desired location. A cylindrical socket 24 is provided for mounting an adjustable sunshade on the tray 12. The cylindrical socket 24 is formed in the radially extending vertical dividing wall 22.

Figure 2:
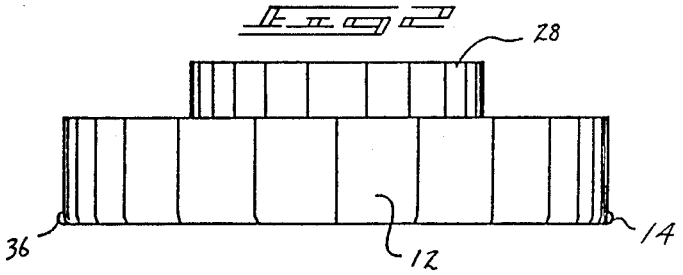
FIG. 2 is a side view of a compartmentalized tray of FIG. 1.

In FIG. 2, a side view of the tray 12 is provided.

Figure 3:
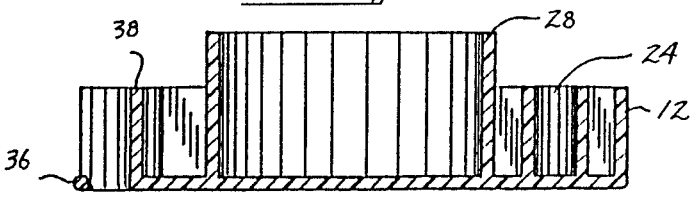
FIG. 3 is a cross sectional view, taken along line 3—3 of FIG. 1, illustrating the construction of the circular tray of the first embodiment of the present invention.

In FIG. 3, a transverse cross sectional view illustrates the constructional details of the compartmentalized tray 12.

Figure 4:
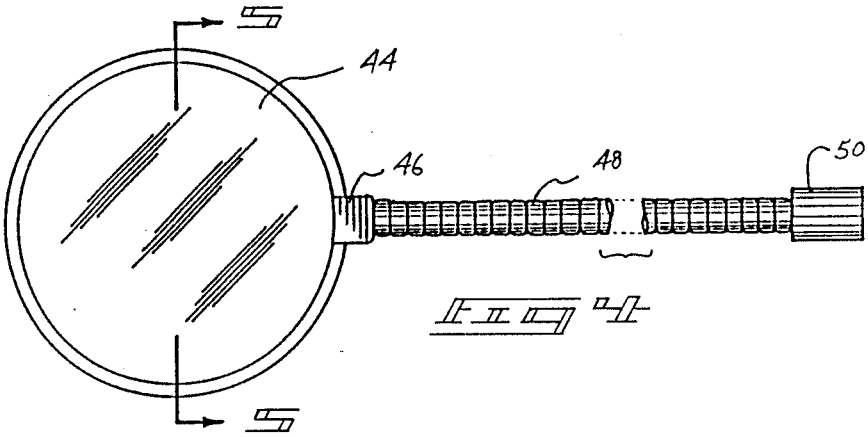
FIG. 4 is a side view of a sunshade attachment for use with the anchor device of the present invention.

In FIG. 4, a plan view is provided which illustrates the adjustable sunshade for use with the anchor device 10 according to the first embodiment of the present invention. The sunshade includes a flat circular disc 44 of a tinted or opaque material which is secured by a clamp 46 to a flexible gooseneck 48. The gooseneck 48 terminates in a cylindrical plug 50 dimensioned to be received within the socket 24 on the tray 12. The plug 50 may be rotated within the socket 24, to adjust the position of the sunshade 44. The flexible gooseneck 48 allows the sunshade 44 to be bent in any desired direction.

Figure 5:
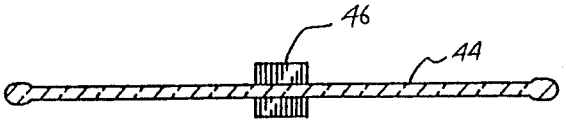
FIG. 5 is a cross sectional view, taken along line 5—5 of FIG. 4, illustrating the construction of the sunshade.

In FIG. 5, a transverse cross sectional view illustrating the sunshade 44, is provided.

Figure 6:
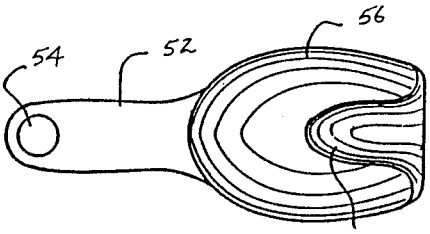
FIG. 6 is a top view of a spoon type anchor.

In FIG. 6, a top view of a spoon type anchor for attachment to the tray 12 is provided. The anchor has an elongated narrow shank 52 provided with a circular aperture for reception of an anchor rope. The anchor rope will then be attached to the anchor tether rod 36 on the tray 12. The anchor shank 52 is integrally formed with an enlarged concave body portion 56 which has a generally spoon shaped configuration. The body portion 56 tapers to a narrow concave hook portion 58 which is bent along a radius toward the shank 52. In use, the hook 58 and concave body portion 56 of the anchor will dig into the earth at the bottom of a lake or pond. Thus, the anchor serves to restrain the tray 12 and attached inflatable raft or cushion in a desired location.

Figure 7:
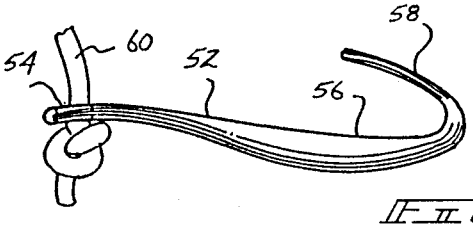
FIG. 7 is a side view of the spoon type anchor of FIG. 6.

In FIG. 7, a side view of the anchor of FIG. 6 is provided. A portion of the anchor rope 60 is illustrated secured through the cylindrical aperture 54 in the shank 52.

Figure 8:
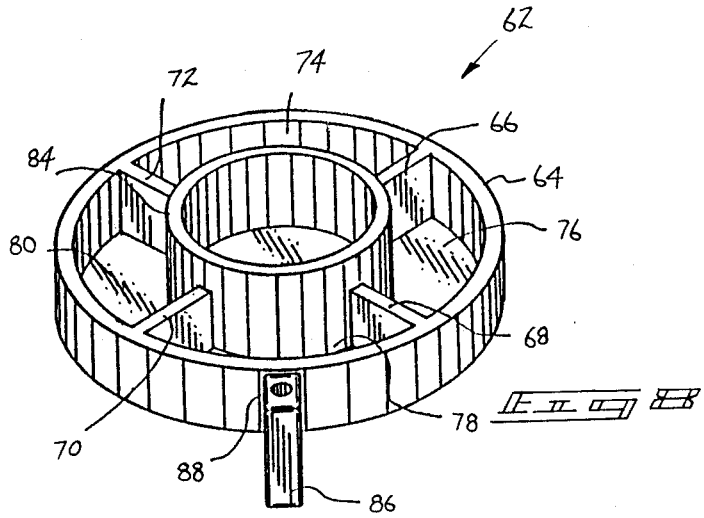
FIG. 8 is a perspective view of a circular compartmentalized tray according to a second embodiment of the present invention.

In FIG. 8, a perspective view is provided which illustrates a circular compartmentalized tray 62 according to a second embodiment of the present invention. The tray 62 has a cylindrical side wall 64 which is divided into a plurality of compartments 74, 76, 78 and 80 by a plurality of radially extending vertical dividing walls 66, 68, 70 and 72. A cylindrical beverage holder 82 is centrally formed on the tray 62 by an upstanding cylindrical side wall 84. The radially extending dividers 66, 68, 70 and 72 extend between the beverage holder side wall 84 and the tray side wall 64. A sunshade mounting block 86 is slidably connected to the tray 62 and is provided with a cylindrical socket 88 for the reception of the cylindrical plug 50 of the sunshade illustrated in FIG. 4.

Figure 9:
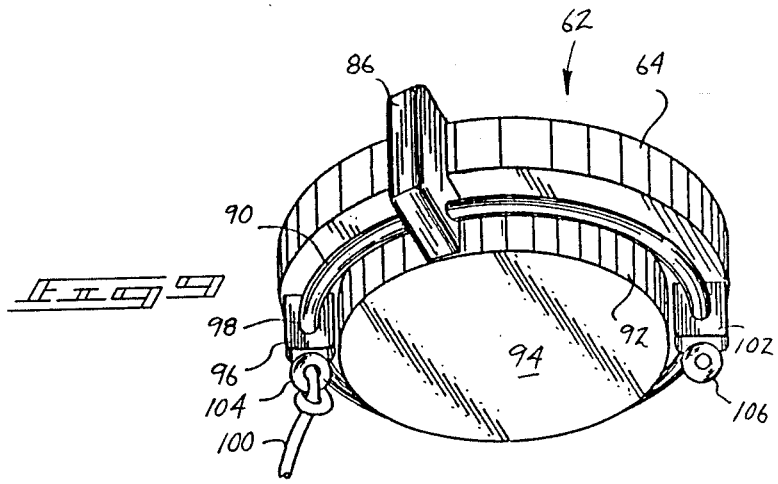
FIG. 9 is a perspective view, illustrating the underside of the circular compartmentalized tray according to the second embodiment of the present invention.

In FIG. 9, a perspective view is provided which illustrates the underside of the tray 62 of FIG. 8. A slide ring 90, having a notched circular transverse cross section, is secured to the underside of the tray 62 by a pair of diametrically opposed tether mounting blocks 96 and 102. A swivel ring 104 and 106 is secured to each of the tether mounting blocks 96 and 102. The swivel ring 104 is adapted for attachment to an anchor rope 100. The swivel ring 106 is adapted for attachment with an inflatable raft or cushion by a short length of cord or rope. A reduced diameter cylindrical side wall 92 extends downwardly from the bottom of the upper cylindrical portion 64 of the tray 62. The lower cylindrical portion 92 has a flat bottom surface 94. The upper cylindrical portion 64, lower cylindrical portion 92 and circular slide ring 90 are all coaxially disposed. The sunshade mounting block 86 is slidably mounted on the slide rod 90, to provide an adjustment of the sunshade position.

Figure 10:
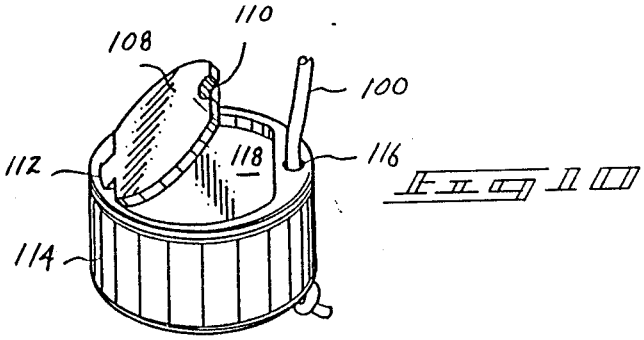
FIG. 10 is a perspective view of a weighted anchor for use in the anchor device of the present invention.

In FIG. 10, a weighted cylindrical anchor 114 is illustrated. The anchor 114 has a hollow central compartment 118 which is adapted to be closed by a pivotal cover 108 which is mounted by a hinge 112. The cover 108 is provided with a semicircular thumb recess 110 to facilitate opening of the cover 108. A circular aperture 116 extends through the cylindrical body portion 114 of the weighted anchor and is adapted to receive the end of the anchor rope 100. When the anchor rope 100 is not in use, it is designed to be coiled and stored within the hollow interior 118 of the cylindrical weighted anchor 114.

Figure 11:
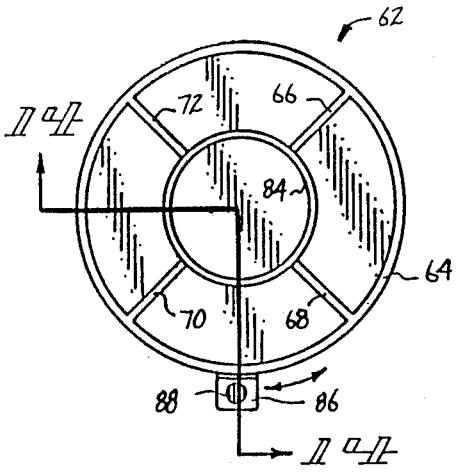
FIG. 11 is a top view of the circular tray of FIG. 8.

In FIG. 11, a top view of the tray 62 is provided. As may now be understood, the sunshade mounting block 86 may be angularly adjusted as indicated by the arrows.

Figure 12:
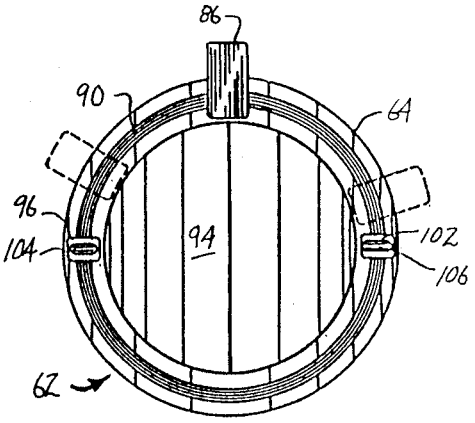
FIG. 12 is a bottom view of the circular tray of FIG. 11.

In FIG. 12, a bottom view of the tray 62 is provided. The slide ring 90 is connected to the tray 62 by virtue of engagement with the tether mounting blocks 96 and 102 which are attached to or integrally formed with the bottom of the upper cylindrical portion 64 of the tray 62. The range of adjustment of the sunshade mounting block 86 is illustrated in dotted lines.

Figure 13:
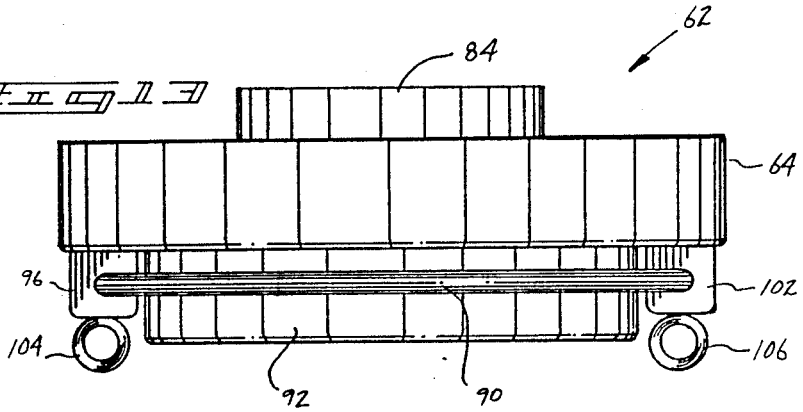
FIG. 13 is a side view of the circular tray of FIG. 12.

In FIG. 13, a side view of the tray 62 is provided. The tray 62 may be formed from any conventional material, but is preferably formed from a molded plastic material to ensure light weight and flotation. The swivel tether rings 104 and 106 are mounted at diametrically opposed locations on opposite sides of the tray 62.

Figure 14:
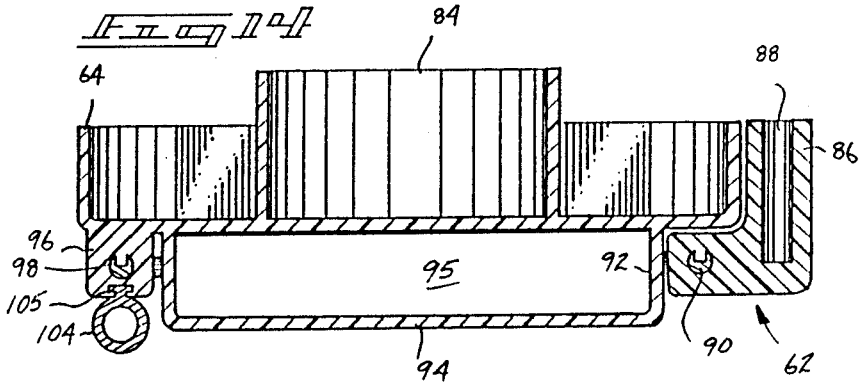
FIG. 14 is a cross sectional view, taken along line 14—14 of FIG. 11, illustrating the construction of the circular tray according to the second embodiment of the present invention.

As shown in the cross sectional view of FIG. 14, the slide rod 90 has a circular notched configuration. The tether mounting blocks 96 and 102 and the sunshade mounting block 86 are provided with cooperating recesses for engagement with the ring 90. Each of the tether rings 104 and 106 is provided with an attached circular stem portion 105 which is rotatably received in a recess formed in each of the tether mounting blocks 96 and 102. The sunshade mounting block 86 is formed with a relatively close tolerance engagement with the slide ring 90, such that the sunshade holder 86 will remain in a selected adjusted position. An enclosed cylindrical compartment 95 is filled with styrofoam to ensure flotation of the tray 62. The styrofoam filled compartment 95 is bounded by the cylindrical side wall 92, the flat bottom surface 94 and the flat bottom surface of the upper tray portion 64.

Figure 15:
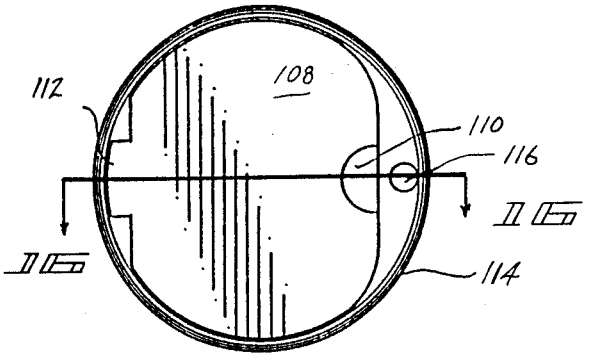
FIG. 15 is a top view of the anchor of FIG. 10.

In FIG. 15, a top view of the weighted anchor 114 of FIG. 10 is provided.

Figure 16:
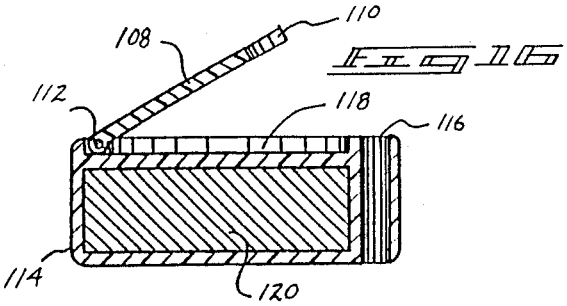
FIG. 16 is a cross sectional view, taken along line 16—16 of FIG. 15, illustrating the internal construction of the anchor of FIG. 10.

In FIG. 16, a transverse cross sectional view, taken along line 16—16 of FIG. 15 is provided. A cylindrical disc shaped lead weight 120 is enclosed within the anchor 114, and serves to retain the anchor 114 on the bottom of a body of water. A cylindrical upper recess 18 in the anchor 114 is adapted to be closed by a cover 108 which is pivotally mounted by a hinge 112 to the anchor 114. As previously mentioned, an anchor rope may be coiled and stored within the recess 118, when not in use.

Figure 17:
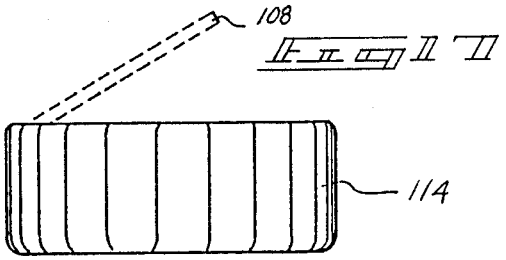
FIG. 17 is a side view of the anchor of FIG. 15.

In FIG. 17, a side view of the anchor 114 is provided. The open position of the cover 108 is illustrated in dotted lines.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. An anchor device for securing an inflatable raft or cushion at a desired location in a body of water, comprising:

a circular tray having an upstanding cylindrical side wall;

adjustable sunshade means on said tray;

a beverage holder on said tray including a centrally disposed cylindrical recess formed by a vertical cylindrical wall;

a plurality of circumferentially spaced storage compartments on said tray formed by a plurality of radially extending vertical dividers;

means on said tray for tethering said inflatable raft or cushion;

anchor rope means tethered to said tray; and anchor means attached to said anchor rope means.

2. The anchor device of claim 1, further comprising a cylindrical sunshade mounting socket formed on one of said radially extending dividers.

3. The anchor device of claim 2, further comprising a pair of diametrically opposed circular recesses formed in said circular tray cylindrical side wall; and a tether rod extending across each of said circular recesses.

4. The anchor device of claim 3, wherein said adjustable sunshade means comprises a sunshade having a flexible gooseneck terminating in a cylindrical plug received in said sunshade socket.

5. The anchor device of claim 4, wherein said sunshade further comprises a flat circular disc mounted on said flexible gooseneck.

6. The anchor device of claim 1, wherein said anchor means comprises a spoon shaped anchor having an elongated shank with an integrally formed enlarged concave body portion terminating in a curved concave tapered hook.

7. The anchor device of claim 1, wherein said anchor means comprises a weighted cylindrical anchor.

8. The anchor device of claim 7, wherein said cylindrical anchor has a central recess provided with a hinged cover.

9. An anchor device for securing an inflatable raft or cushion at a desired location in a body of water, comprising:

tray means;

adjustable sunshade means on said tray means;

beverage holder means on said tray means;

storage compartment means on said tray means;

diametrically opposed tether blocks on a bottom surface of said tray means;

means for tethering an inflatable raft or cushion to one of said tether blocks;

anchor rope means tethered to the other of said tether blocks; and anchor means attached to said anchor rope means.

10. The anchor device of claim 9, further comprising a swivel tether ring on each of said tether blocks.

11. The anchor device of claim 10, further comprising a slide ring having a notched circular transverse cross section extending through said tether blocks.

12. The anchor device of claim 11, further comprising a sunshade mounting block having an aperture receiving said slide ring.

13. The anchor device of claim 12, further comprising a cylindrical recessed sunshade mounting socket on said sunshade mounting block.

14. The anchor device of claim 13, wherein said adjustable sunshade means comprises a sunshade having a flexible gooseneck terminating in a cylindrical plug received in said sunshade socket.

15. The anchor device of claim 14, further comprising a cylindrical styrofoam filled flotation compartment on a bottom surface of said tray means.

* * * * *